US005207190A

United States Patent [19]

Torigai et al.

[11] Patent Number: 5,207,190

[45] Date of Patent: May 4, 1993

[54] V-TYPE FUEL INJECTION TWO CYCLE ENGINE

[75] Inventors: Katsumi Torigai; Masanori Takahashi, both of Hamamatsu, Japan

[73] Assignee: Sanshin Kogyo Kabushiki Kaisha, Hamamatsu, Japan

[21] Appl. No.: 907,388

[22] Filed: Jul. 1, 1992

[30] Foreign Application Priority Data

Aug. 28, 1991 [JP] Japan ..... 3-240277

[51] Int. Cl.[5] ..... F02M 35/10

[52] U.S. Cl. ..... 123/55 VS; 123/73 A

[58] Field of Search ..... 123/55 VF, 55 VS, 73 A, 123/73 AD, 74 A

[56] References Cited

U.S. PATENT DOCUMENTS

| | | | |
|---|---|---|---|
| 3,280,805 | 10/1966 | Muller | 123/55 VS |
| 4,290,394 | 9/1981 | Frank et al. | 123/73 A |
| 4,519,471 | 5/1985 | Miyakoshi et al. | 123/55 VF |
| 4,920,933 | 5/1990 | Iwai et al. | 123/73 A |
| 5,085,180 | 2/1992 | Torigai | 123/73 A |
| 5,143,028 | 9/1992 | Takahashi | 123/55 VS |

FOREIGN PATENT DOCUMENTS

| | | | |
|---|---|---|---|
| 59-46359 | 3/1984 | Japan . | |
| 1-170758 | 7/1989 | Japan . | |
| 2-40079 | 2/1990 | Japan . | |
| 0104921 | 4/1990 | Japan | 123/55 VS |

*Primary Examiner*—David A. Okonsky
*Attorney, Agent, or Firm*—Ernest A. Beutler

[57] ABSTRACT

An induction system for a crankcase compression, two cycle, V-type internal combustion engine having a compact configuration. The engine cylinder banks are disposed at a V-angle and define a valley therebetween in which the induction system is positioned. A fuel injector is supplied for spraying fuel to each of the intake ports and the fuel injectors are disposed in the valley of the engine each between the respective induction system and the cylinders served by it.

20 Claims, 3 Drawing Sheets

V-TYPE FUEL INJECTION TWO CYCLE ENGINE

BACKGROUND OF THE INVENTION

This invention relates to a V-type, fuel injection, two cycle engine and more particularly to an improved layout of the induction and fuel injection system for such an engine, particularly as applied to an outboard motor.

Because of the numerous advantages of two cycle, internal combustion engines, they are frequently used as the power plant in marine propulsion units such as outboard motors. However, as the requirement for greater power outputs exist, certain problems result in connection with the layout of the various components of two cycle engines. Particularly, because of the necessity for a very compact engine relationship, there is some difficulty in laying out certain of the components for an engine having multiple cylinders, particularly when applied in an outboard motor application. For example, it is known that an engine of a given displacement can be more compact if the cylinders are arranged in banks disposed at an angle to each other. Such engines are normally called "V-type" engines.

However, when the engine is also of the two cycle, crankcase compression type, it has been the practice to design the induction system so that it supplies a charge directly to the crankcase chambers of the engine from the crankcase side of the engine. This means, of course, that the engine tends to become rather bulky with the cylinder banks extending from one side of the crankcase and the induction system extending from the other side of the crankcase.

It is, therefore, a principal object to this invention to provide an improved induction system for a V-type, crankcase compression, internal combustion engine.

It is a further object to this invention to provide a compact engine and induction system of the two cycle, V-type crankcase compression type.

In addition to the problems of the air induction for the crankcase chambers of the engine, there is also the consideration of providing fuel for the charge forming system of the engine. If carburetors are employed, they generally discharge into an intake manifold which, in turn, supplies the charge to the crankcase chambers. However if the induction system is on the opposite side of the crankcase from the cylinder blocks and such a carburetor intake manifold system is employed, the engine becomes even more bulky.

It is, therefore, a still further object to this invention to provide an improved fuel injection and induction system for a two cycle, crankcase compression, internal combustion engine.

It is a further object to this invention to provide an improved and compact fuel injected, crankcase compression, V-type, two cycle internal combustion engine.

When fuel injectors are employed and a manifold type of injection system is incorporated, then additional problems result in the design of the induction system. That is, the fuel injector should be disposed in such an area that they spray a fairly uniform fuel spray across the induction passage into which they inject. Also, it is normally the practice to employ a check valve arrangement in the induction system of the two cycle, crankcase compression engine so as to preclude reverse flow through the induction system when the charge is being compressed in the crankcase chambers. It is important to insure an appropriate interrelationship between the location of the fuel injectors and the check valves so as to insure uniform fuel distribution.

It is, therefore, a still further object to this invention to provide an improved fuel injected, crankcase compression, V-type, two cycle internal combustion engine including check valves in the induction system.

SUMMARY OF THE INVENTION

This invention is adapted to be embodied in a fuel injection and induction system for a two cycle, crankcase compression, V-type, internal combustion engine which comprises a crankcase and a pair of cylinders extending from the crankcase at an angle to each other to define a valley therebetween. A pair of intake ports are provided, one for each of the cylinders and disposed in the valley. A pair of intake pipes are disposed in the valley and each serves a respective one of intake ports for supplying a charge thereto. A pair of fuel injectors are also disposed in the valley and each supplies fuel to a respective one of the intake ports.

DETAILED DESCRIPTION OF THE PREFERRED EMBODIMENT OF THE INVENTION

Figure 1:
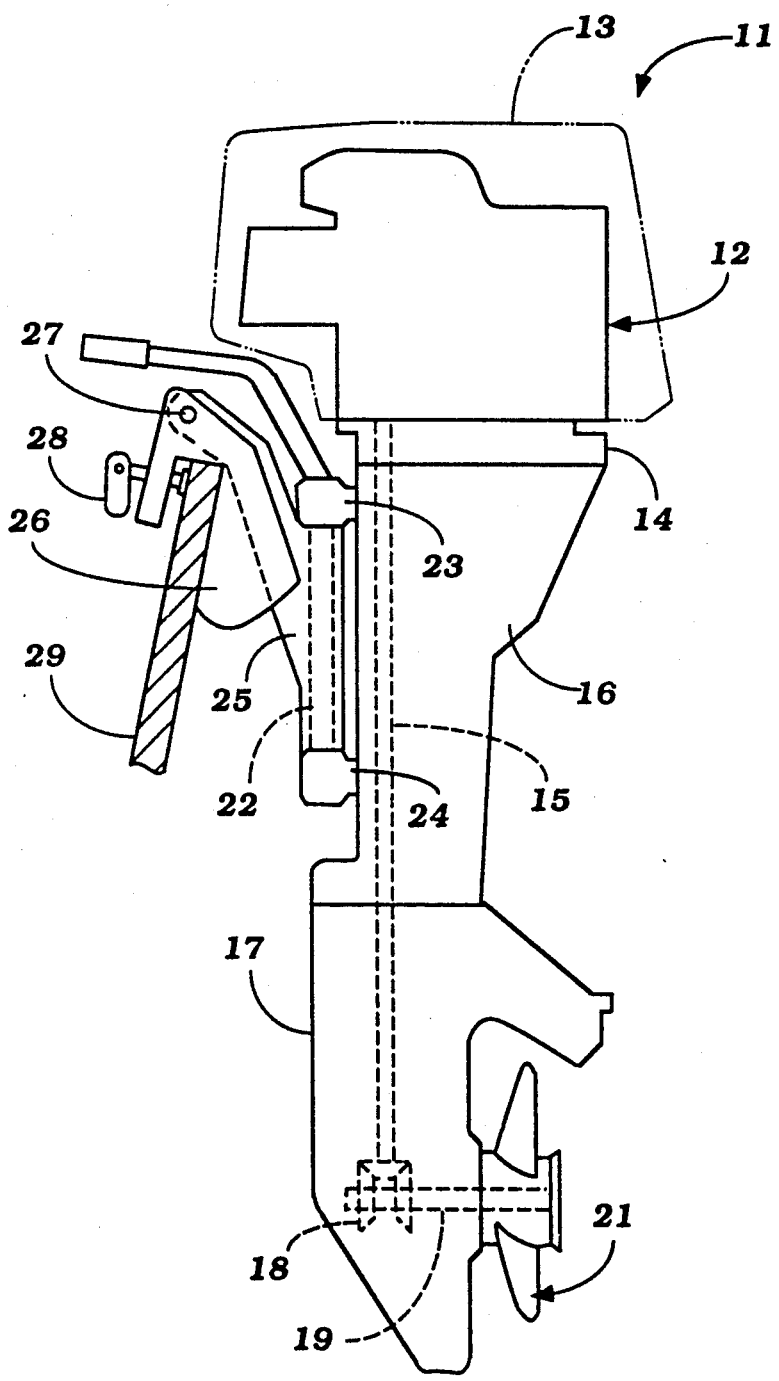
FIG. 1 is a side elevational view of an outboard motor constructed in accordance with an embodiment of the invention and shown as attached to the transom of an associated watercraft, which is shown partially and in cross section.

Referring now in detail to the drawings and initially to FIG. 1, an outboard motor is depicted and identified generally by the reference numeral 11. The invention is described in conjunction with an outboard motor because the invention has particular utility with marine drives wherein two cycle internal combustion engines are normally employed as the power unit. The invention relates specifically to an induction and fuel injection system for such engines and, therefore, the depiction of the invention in conjunction with an outboard motor is merely exemplary.

The outboard motor 11 includes a power head that is comprised of a powering internal combustion engine, indicated generally by the reference numeral 12 and which is surrounded by a protective cowling, shown in phantom and identified by the reference numeral 13. This power head is mounted at the top of a supporting plate 14.

As will become apparent as this description proceeds, the engine 12 is supported so that its output shaft rotates about a vertically extending axis. This engine output shaft is connected to a drive shaft 15 that is journalled for rotation about a vertically extending axis in a drive shaft housing 16 that depends from the supporting plate 14. This drive shaft 15 depends into a lower unit 17 in which a conventional forward, neutral, reverse bevel gear transmission 18 is incorporated for selectively driving a propeller shaft 19 in forward or reverse directions. A propeller 21 is affixed to the end of the propeller shaft 19 for powering the associated watercraft in a well known manner.

A steering shaft 22 is affixed by upper and lower brackets 23 and 24 to the drive shaft housing 16 and is journalled for steering movement about a generally vertically extending steering axis within a swivel bracket 25. The swivel bracket 25 is, in turn, pivotally connected to a clamping bracket 26 by means of a horizontally extending pivot pin 27 for tilt and trim movement of the outboard motor 11, as is well known in this art. The clamping bracket 26 includes a clamping assembly 28 for affixing the outboard motor to a transom 29 of an associated watercraft.

Figure 2:
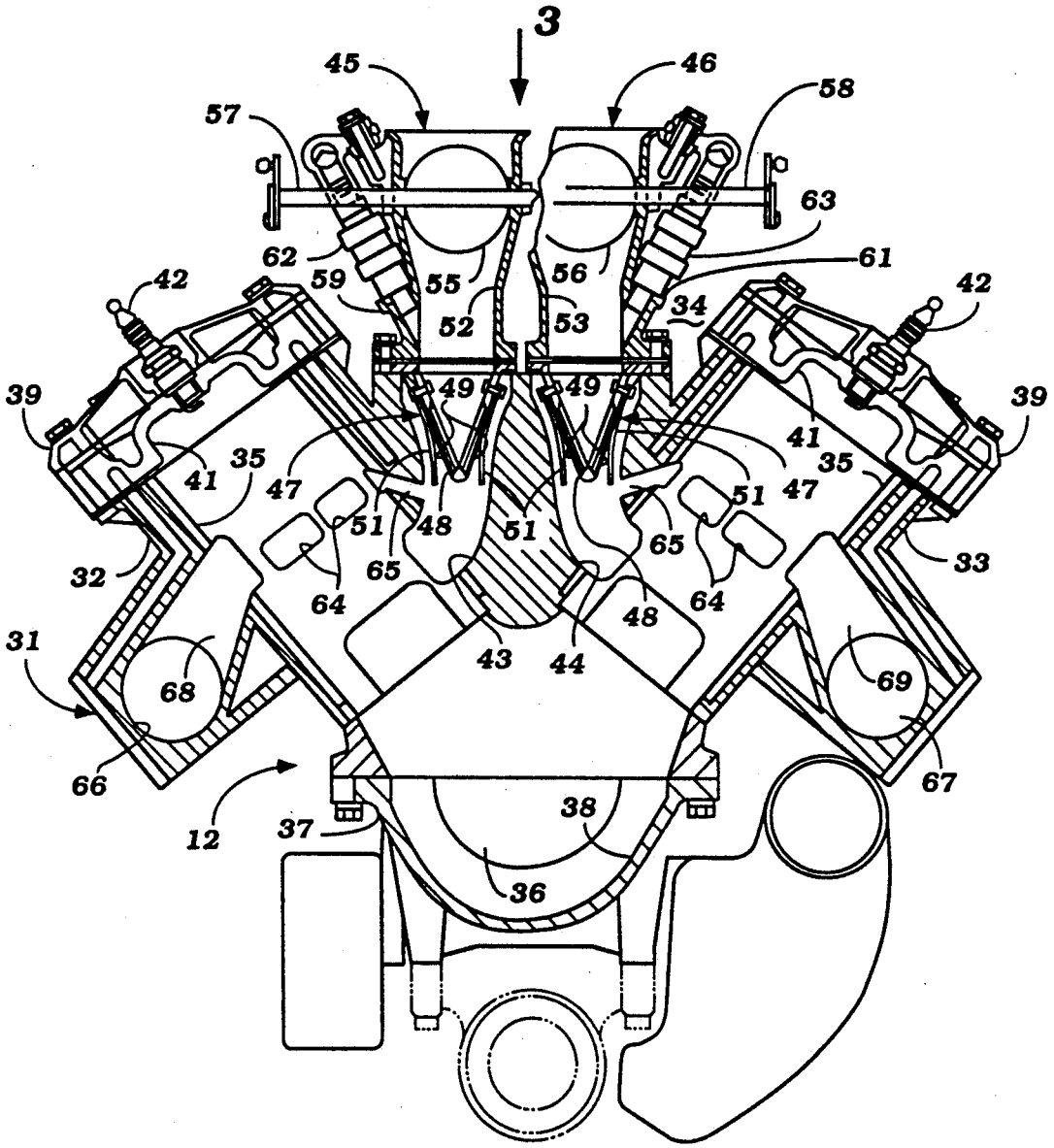
FIG. 2 is a top plan view of the internal combustion engine of the power head of the outboard motor with portions broken away and shown in cross section.
Figure 3:
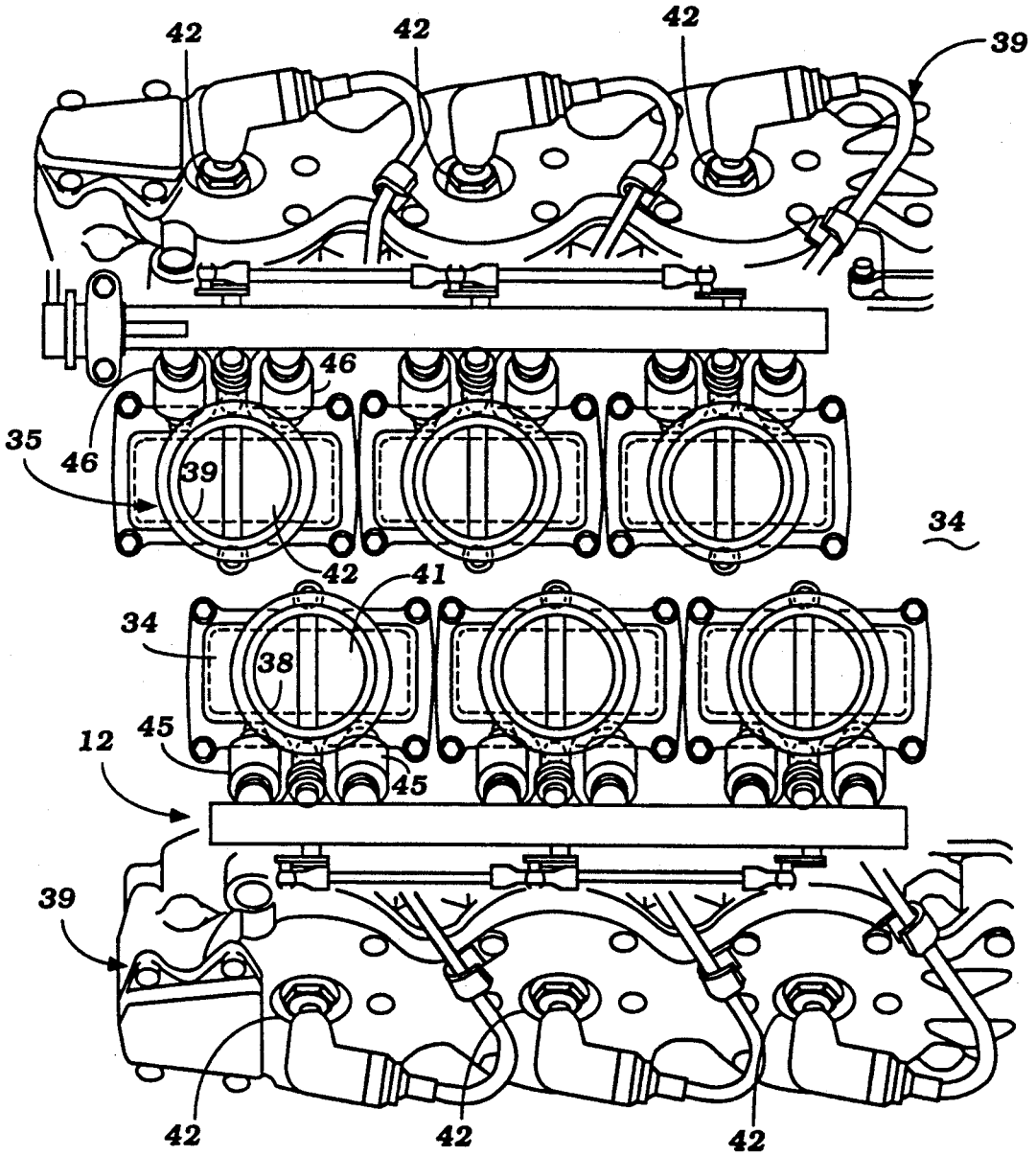
FIG. 3 is an enlarged view of the induction system for the engine and taken generally in the direction of the arrow 3 in FIG. 2.

Referring now in detail to FIGS. 2 and 3, the engine 12 will be described in more detail. The engine 12 is of the V6, two cycle, crankcase compression, internal combustion type. To this end, the engine 12 is provided with a cylinder block, indicated generally by the reference numeral 31 and which has a pair of inclined cylinder banks 32 and 33 which are disposed at a V-type angle and which define a valley 34 therebetween. Each of the cylinder banks 32 and 33 is formed with a plurality of aligned cylinder bores 35 by means of cylinder liners that are cast or pressed in place.

Pistons (not shown) are slidably supported in each of the cylinder bores 35 and are connected by means of connecting rods (not shown) to a respective throws of a crankshaft 36 that is journalled for rotation within a crankcase formed by the skirt of the cylinder block 31 and a crankcase member 37 that is affixed thereto in a known manner.

As is typical with two cycle, internal combustion engine practice, the crankcase is divided into a plurality of chambers 38, with each chamber 38 communication with a respective one of the cylinder bores 35. Since the invention deals primarily with the induction system for the engine rather than its internal mechanical construction, the relationship of the pistons, connecting rods and crankshaft 36 is not shown in any detail as those skilled in the art will readily understand how the invention can be practiced with any known type of two cycle, crankcase compression engine.

A cylinder head assembly 39 is affixed to each of the cylinder banks 32 and 33 in a suitable manner and has individual recesses 41 that cooperate with the respective cylinder bores 35 and the heads of the pistons to define the variable volume chamber which, at minimum volume, comprises the combustion chamber of the engine. Spark plugs 42 are mounted in the cylinder head assemblies 39 and are fired by a suitable ignition system.

With typical two cycle, crankcase compression engines, a fuel/air charge is delivered to the crankcase chambers 38 through an induction system that communicates with the crankcase chambers 38 through the crankcase member 37. Therefore this induction system, of a conventional engine extends from the crankcase chambers 38 in a direction opposite to the cylinder banks 32 and 33. This obviously will significantly increase the overall size of the engine, as should be readily apparent. As has been previously noted, this type of arrangement will become further bulky if carburetors supply the fuel/air charge to the induction system.

In accordance with an important feature of the invention, the cylinder banks 32 and 33 are each provided with a respective series of intake ports 43 and 44 which are disposed in the valley 34 and which communicate with the crankcase chambers 38 through the cylinder block 31. These intake ports 43 and 44 extend generally parallel to each other and terminate at respective openings in the valley 34 to which intake manifolds 45 and 46 are attached in a suitable manner.

As is typical with two cycle, crankcase compression engines, reed type check valves 47 are positioned in each of the intake ports 43 and 44 so as to permit a flow to the crankcase chambers 38 when the pistons are moving upwardly and for precluding flow in a reverse direction through the intake ports 43 and 44 when these pistons are moving downwardly to compress the charge in the crankcase chambers 38. The reed type check valves 47 include mounting cages 48 that have a generally V-type configuration with their apexes extending generally parallel to the axis of rotation of the crankshaft 36 as clearly shown in FIG. 2. Reed type valve plates 49 are affixed to the opposite sides of the cages 48 in a suitable manner and are backed up by stopper plates 51 so as to limit the degree of opening of the reed type valves 49 and reduce the stresses on them, as is well known in this art.

The manifolds 45 and 46 have individual runners 52 and 53 which communicate an air inlet device (not shown) that provides silencing of the inlet air and which draws the air from the interior of the protective cowling 13 in a known manner. These intake runners 52 and 53 each register with a respective one of the cylinder block intake ports 43 and 44 and, like the intake ports 43 and 44, extend generally parallel to each other and are disposed in the valley 34.

Throttle valves 55 and 56 are positioned in each of the intake runners 52 and 53, respectively, and are affixed to respective throttle valve shafts 57 and 58. As is typical with V-type engine practice, the cylinder bores 35 of the bank 32 are offset slightly from the cylinder bores 34 of the bank 33 so that the connecting rods of adjacent cylinders of the respective banks may be journalled on the same throw of the crankshaft. This stagger clearly appears in FIG. 3. It should be noted that the stagger is such that the intake manifolds 45 and 46 are spaced relatively closely to each other and provide a very compact arrangement which, nevertheless, may be conveniently positioned in the valley 34 so as to provide a compact assembly. Also, it should be noted that the intake ports 43 and 44 and intake manifolds 45 and 46 are disposed so that they do not significantly increase the length of the engine in a horizontal direction as clearly shown in FIG. 2.

Each of the intake manifolds 45 and 46 is provided with a pair of respective bosses 59 and 61 on the side of the manifolds 45 and 46 adjacent the cylinder banks 32 and 33 which it serves. Each of the bosses 59 and 61 receives a pair of respective fuel injectors 62 and 63 which are disposed so that their spray axes will be generally aligned with the bight of the valve cage 48 so that the fuel sprayed by the respective paired injectors 62 and 63 into the intake passages 52 and 53 will be generally centrally disposed and will impact upon the valve cage 48 so as to insure a uniform mixture distribution across the intake ports 43 and 44.

Since the bosses 59 and 61 are aligned in a longitudinal direction as are the bights of the valve cages 48 and 49, it is possible to use paired fuel injectors 62 and 63 for each of the intake passages 52 and 53 and to insure good uniform fuel distribution. It should be understood, of course, that it is not necessary to use paired fuel injectors for each of intake ports 43 and 44 and only a single fuel injector 62 and 63 may be employed for each intake port 43 and 44. The use of paired fuel injectors, however, permits a greater degree of accuracy and control over a wider range of fuel delivery.

The fuel/air charge that is delivered to each of the crankcase chambers 38 through the respective intake ports 43 and 44 is compressed, as aforenoted, upon downward movement of the piston. This compressed charge is then transferred to the respective cylinder bore 45 through scavenge ports 64 which extend from the individual crankcase chambers 38 to the cylinder bore 43. In addition, a scavenge port 65 may be provided that communicates directly with the intake ports 43 and 44.

The charge which is then transferred into the combustion chambers is fired, as aforenoted, by the spark plugs 42 and then is discharged into respective exhaust manifold portions 66 and 67, formed in the respective cylinder banks 33 and 34 through exhaust ports 68 and 69 in a well known manner.

It should be readily apparent that the described construction provides an extremely compact V-type, two cycle, crankcase compression, internal combustion engine that accommodates the use of fuel injectors. Although the construction is compact, it should be readily apparent that the fuel injectors 62 and 63 are disposed in an area where they may be easily reached for servicing. Of course, the foregoing description is that of a preferred embodiment of the invention and various changes and modifications may be made without departing from the spirit and scope of the invention, as defined by the appended claims.

We claim:

1. A fuel injector and induction system for a two cycle, crankcase compression, V-type internal combustion engine comprising a crankcase, a pair of cylinders extending from said crankcase at an angle to each other to define a valley therebetween, a pair of intake ports, one for each of said cylinders, disposed in said valley, a pair of intake pipes disposed in said valley, each serving a respective one of said intake ports for supplying a charge thereto, and a pair of fuel injectors disposed in said valley, each supplying fuel to a respective one of said intake ports.

2. A fuel injector and induction system as set forth in claim 1 wherein the fuel injectors are disposed between the intake ports and the cylinders served thereby.

3. A fuel injector and induction system as set forth in claim 2 wherein the intake pipes and the intake ports extend generally parallel to each other.

4. A fuel injector and induction system as set forth in claim 3 further including a pair of reed type check valves, each positioned in a respective one of the intake ports for permitting flow from the intake pipe into the crankcase while precluding flow in a reverse direction.

5. A fuel injector and induction system as set forth in claim 4 wherein each reed type check valve has a generally V-shaped configuration defined by a cage to which a pair of reed type valves are affixed and wherein the bight of the cage extends substantially parallel to the axis of rotation of a crankshaft rotatably journalled in the crankcase.

6. A fuel injector and induction system as set forth in claim 5 wherein each fuel injectors sprays toward and against the bight of the V-type check valves.

7. A fuel injector and induction system as set forth in claim 1 wherein the intake pipes and the intake ports extend generally parallel to each other.

8. A fuel injector and induction system as set forth in claim 7 further including a pair of reed type check valves, each positioned in a respective one of the intake ports for permitting flow from the intake pipe into the crankcase while precluding flow in a reverse direction.

9. A fuel injector and induction system as set forth in claim 8 wherein each reed type check valve has a generally V-shaped configuration defined by a cage to which a pair of reed type valves are affixed and wherein the bight of the cage extends substantially parallel to the axis of rotation of a crankshaft rotatably journalled in the crankcase.

10. A fuel injector and induction system as set forth in claim 9 wherein each fuel injectors sprays toward and against the bight of the V-type check valves.

11. A fuel injector and induction system as set forth in claim 1 wherein the cylinders are formed as a part of a cylinder block assembly to which the crankcase is affixed, the cylinders of said cylinder block assembly being staggered relative to each other and the intake ports being formed in the cylinder block and communicating with the crankcase through the cylinder block.

12. A fuel injector and induction system as set forth in claim 11 wherein the fuel injectors are disposed between the intake ports and the cylinders served thereby.

13. A fuel injector and induction system as set forth in claim 12 wherein the intake pipes and the intake ports extend generally parallel to each other.

14. A fuel injector and induction system as set forth in claim 13 further including a pair of reed type check valves, each positioned in a respective one of the intake ports for permitting flow from the intake pipe into the crankcase while precluding flow in a reverse direction.

15. A fuel injector and induction system as set forth in claim 14 wherein each reed type check valve has a generally V-shaped configuration defined by a cage to which a pair of reed type valves are affixed and wherein the bight of the cage extends substantially parallel to the axis of rotation of a crankshaft rotatably journalled in the crankcase.

16. A fuel injector and induction system as set forth in claim 15 wherein each fuel injectors sprays toward and against the bight of the V-type check valves.

17. A fuel injector and induction system as set forth in claim 11 wherein the intake pipes and the intake ports extend generally parallel to each other.

18. A fuel injector and induction system as set forth in claim 17 further including a pair of reed type check valves, each positioned in a respective one of the intake ports for permitting flow from the intake pipe into the crankcase while precluding flow in a reverse direction.

19. A fuel injector and induction system as set forth in claim 18 wherein each reed type check valve has a generally V-shaped configuration defined by a cage to which a pair of reed type valves are affixed and wherein the bight of the cage extends substantially parallel to the axis of rotation of a crankshaft rotatably journalled in the crankcase.

20. A fuel injector and induction system as set forth in claim 19 wherein each fuel injectors sprays toward and against the bight of the V-type check valves.

* * * * *